US007122953B2

(12) United States Patent
Piena

(10) Patent No.: US 7,122,953 B2
(45) Date of Patent: Oct. 17, 2006

(54) HIGH PRESSURE DISCHARGE LAMP AND METHOD OF MANUFACTURING AN ELECTRODE FEEDTHROUGH FOR SUCH A LAMP

(75) Inventor: Martinus Johannes Piena, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/500,684

(22) PCT Filed: Dec. 19, 2002

(86) PCT No.: PCT/IB02/05633

§ 371 (c)(1),
(2), (4) Date: Jul. 2, 2004

(87) PCT Pub. No.: WO03/058674

PCT Pub. Date: Jul. 17, 2003

(65) Prior Publication Data

US 2005/0017642 A1 Jan. 27, 2005

(30) Foreign Application Priority Data

Jan. 8, 2002 (EP) ..... 02075030

(51) Int. Cl.
*H01J 63/04* (2006.01)

(52) U.S. Cl. ..... 313/491; 313/631

(58) Field of Classification Search ..... 327/31, 327/165, 166, 170, 261, 263, 264, 276–278, 327/284, 285, 427; 313/491, 631, 633

See application file for complete search history.

(56) References Cited

U.S. PATENT DOCUMENTS

| | | | | |
|---|---|---|---|---|
| 4,808,881 | A * | 2/1989 | Kariya et al. | 313/624 |
| 4,905,192 | A * | 2/1990 | Nogami et al. | 365/200 |
| 5,132,563 | A * | 7/1992 | Fujii et al. | 326/27 |
| 5,742,124 | A * | 4/1998 | Kees et al. | 313/625 |
| 5,973,453 | A * | 10/1999 | Van Vliet et al. | 313/623 |
| 5,994,946 | A * | 11/1999 | Zhang | 327/403 |
| 6,147,453 | A * | 11/2000 | Geijtenbeek et al. | 313/640 |
| 6,184,702 | B1 * | 2/2001 | Takahashi et al. | 326/21 |
| 6,298,000 | B1 * | 10/2001 | Kitade et al. | 365/222 |
| 6,456,137 | B1 * | 9/2002 | Asao | 327/290 |
| 6,456,545 | B1 * | 9/2002 | Negishi | 365/198 |
| 6,469,442 | B1 * | 10/2002 | Kakisaka et al. | 313/634 |
| 6,574,154 | B1 * | 6/2003 | Sato et al. | 365/198 |
| 6,633,127 | B1 * | 10/2003 | Vos et al. | 313/594 |
| 6,750,611 | B1 * | 6/2004 | Gubbels | 313/623 |
| 6,859,883 | B1 * | 2/2005 | Svestka et al. | 713/320 |
| 6,882,109 | B1 * | 4/2005 | Nakano et al. | 313/625 |
| 6,937,067 | B1 * | 8/2005 | Neaves | 326/93 |

FOREIGN PATENT DOCUMENTS

| | | | |
|---|---|---|---|
| JP | 10-111743 | * | 4/1998 |

* cited by examiner

*Primary Examiner*—Timothy P. Callahan
*Assistant Examiner*—Hai L. Nguyen

(57) ABSTRACT

A high-pressure discharge lamp includes a discharge vessel having a wall of a ceramic material. The lamp also includes at least a feedthrough of an electrode having a cermet rod. The cermet rod is connected at a first end to a first end of a predominantly tungsten electrode pin by a welded joint. The electrode pin is in line with the cermet rod and has, at its first end, a solidified tungsten melt that is located near the interface between electrode pin and cermet rod.

11 Claims, 1 Drawing Sheet

Figure 1:
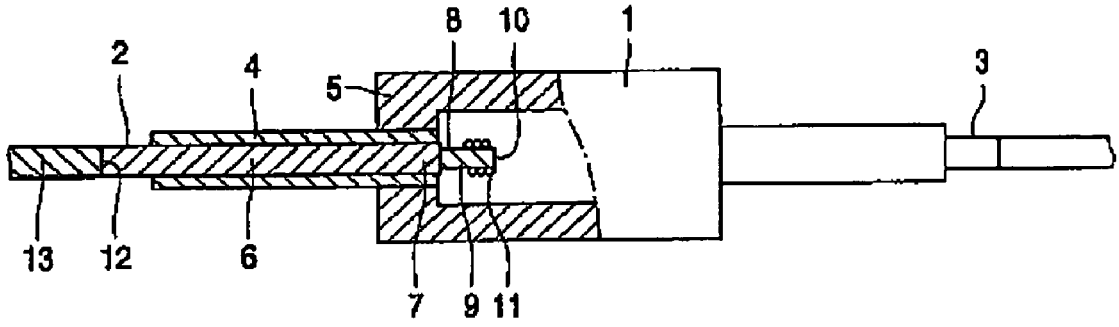

HIGH PRESSURE DISCHARGE LAMP AND METHOD OF MANUFACTURING AN ELECTRODE FEEDTHROUGH FOR SUCH A LAMP

The invention relates to a high-pressure discharge lamp provided with a discharge vessel having a wall of a ceramic material, and provided with at least one electrode feedthrough comprising a cermet rod, which is secured, at a first end, to a first end of an electrode pin by means of a welded joint, which electrode pin is substantially composed of tungsten and extends in line with the cermet rod. The invention further relates to a method of manufacturing an electrode feedthrough for such a high-pressure discharge lamp.

A lamp of the type described in the opening paragraph is known from European patent application EP 0 887 839 A2. Said known lamp is a high-pressure discharge lamp, more particularly a metal-halide lamp. This lamp has a discharge vessel of a ceramic material and is provided with two electrode feedthroughs comprising a cermet rod. In this description and in the claims, ceramic material is to be taken to mean a densely sintered polycrystalline metal oxide, such as aluminum oxide or yttrium aluminum garnet, or a densely sintered polycrystalline metal nitride, such as aluminum nitride. In this description and in the claims, cermet is to be taken to mean a sintered compound of a mixture of ceramic material and a metal, in particular a mixture of aluminum oxide and molybdenum. Such cermets are refractory materials having electroconductive properties. Particularly the cermets of aluminum oxide, which comprise 35 to 70% molybdenum, are found to be very suitable for use in the electrode feedthrough of high-pressure discharge lamps. The cermet rod of the electrode feedthrough of the known lamp is secured to an electrode pin by means of a welded joint, said electrode pin being predominantly composed of tungsten. Said joint between cermet rod and electrode pin is embodied so as to be a butt weld, with an end of the cermet rod being pressed against an end of the electrode pin by exerting a small force, and the weld being formed by directing a laser beam at the interface between the rod and the pin.

The electrode feedthrough of the known lamp has a number of drawbacks. As a result of the operation wherein laser beams are used to produce the welded joint between the cermet rod and the electrode pin, comparatively large quantities of impurities are obtained on the electrode feedthrough and on the tools. These impurities consist in particular of aluminum oxide originating from the cermet rod as a result of evaporation at the location where the laser beam is incident on the rod. This problem is aggravated when use is made of cermet rods having a larger diameter and cermet materials having a comparatively small molybdenum content. As a result, lamps with a higher wattage and higher current intensities are problematic in practice. In addition, at the location of the welded joint, welding edges are formed which seriously hamper the formation of the electrode feedthrough in the wall of the discharge vessel.

It is an object of the invention to provide measures by means of which said drawbacks can be obviated.

A high-pressure discharge lamp of the type mentioned in the opening paragraph is characterized in accordance with the invention in that the electrode pin comprises a solidified tungsten melt at its first end in the vicinity of the interface between electrode pin and cermet rod.

It has been found that a good welded joint between cermet rod and electrode pin can be obtained if, in the course of the welding process, the welding energy is supplied to the electrode pin in an area near the interface between rod and pin, which area does not extend up to the cermet rod, so that direct heating of the cermet is precluded. This area is hereinafter referred to as the welding area. A prerequisite is that the welding area is situated near the interface, i.e. the distance from the center or middle point of the welding area to said interface is at the most equal to half the diameter of the pin. In addition, the welding energy level should be so high that a solidified tungsten melt is formed on the electrode pin at the location of the welding area. At this choice of the welding area and at such values of the welding energy, the first end of the electrode pin is heated to such a high temperature that the temperature of the cermet rod at its first end rises above the melting points of the constituent components of the cermet, so that a welded joint is formed at the interface between rod and pin.

An advantage of a lamp in accordance with the invention resides in that the electrode feedthrough exhibits (substantially) no impurities because evaporation of cermet is precluded. This also has advantages for the manufacture of the feedthroughs because soiling of the tools is precluded. In addition, it is advantageous that a lamp in accordance with the invention does not comprise disturbing welding edges or welding drips at the interface between cermet rod and electrode pin.

Lamps in accordance with the invention are preferred wherein the solidified tungsten melt has a dimension that is at most equal to the diameter of the electrode pin, and the distance from said solidified tungsten to the interface between electrode pin and cermet rod is smaller than half the diameter of the electrode pin. In such lamps, the size of the area to which the welding energy is supplied is at most equal to the diameter of the electrode pin, and the welding area is situated very close to the interface between pin and rod, so that a minimum amount of the welding energy is lost in the process wherein the welded joint is formed. The solidified tungsten, however, should not extend beyond the interface.

In a further preferred embodiment of a lamp in accordance with the invention, the electrode pin exhibits, at its first end, a tungsten melt in three locations on its circumference, which tungsten melts are arranged at an angle of 120° with respect to each other and are at the same distance from the interface. This embodiment enables a very reliable welded joint between cermet rod and electrode pin to be achieved, because during forming the welded joint, the welding energy is supplied, for example by means of three laser beams, in a substantially homogeneously distributed manner to the first end of the electrode pin in a location very close to the interface between rod and pin.

In a practical embodiment of a lamp in accordance with the invention, the cermet rod of the electrode feedthrough is connected by its second end to a niobium pin. The reason for this being that a reliable current supply to the lamp is thus obtained.

Preferably, a lamp in accordance with the invention comprises an electrode pin carrying, at its second end, a tungsten electrode spiral. By virtue thereof, the emission properties of the electrode pin are improved.

A method of manufacturing an electrode feedthrough of a high-pressure discharge lamp in accordance with the invention is characterized in that a cermet rod is arranged such that a first end butts against a first end of a substantially tungsten electrode pin situated in line with the cermet rod, and in that a laser beam is directed at the first end of the electrode pin, at a target point in the vicinity of the interface between electrode pin and cermet rod, as a result of which a welded joint is obtained at the interface between cermet rod and electrode pin and, in addition, a melt, which solidifies upon cooling, is formed at the target point on the first end of the electrode pin.

A method in accordance with the invention has the advantage that the welding energy can be very accurately supplied to the desired location near the interface between cermet rod and electrode pin, as a result of which, on the one hand, impurities are precluded and, on the other hand, welding edges and fins at the cermet rod are avoided.

Preferably use is made of a method in accordance with the invention wherein two or more laser beams are directed at two or more target points on the circumference of the first end of the electrode pin, which target points are situated on the circumference of the electrode pin so as to make equal angles with each other and are situated at an equal distance from the interface between electrode pin and cermet rod. It has been found that this method enables reliable welded joints to be obtained, which can be reproduced very readily. After all, the welding process is only slightly influenced by small variations in the applied welding energy, the diameter of the target points and the focusing of the laser beams. In addition, the welding process is substantially independent of the diameter and the composition of the cermet rod. The method proves to be particularly suitable for electrode pins having larger diameters, for example 1.0 mm or more. It has been found that, in this method, the use of three laser beams arranged so as to make an angle of 120° with each other leads, in practice, to very good results. In addition, the welding energy is reproducibly supplied in a well-localized manner to the desired locations near the interface.

Figure 2:
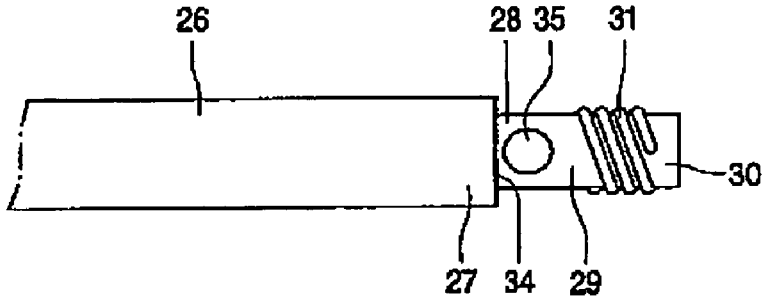

These and other aspects of the lamp and the method in accordance with the invention are apparent from and will be elucidated with reference to a drawing, wherein FIG. 1 diagrammatically shows a side view, partly in section, of a lamp in accordance with the invention; and FIG. 2 shows the electrode feedthrough of the lamp in accordance with FIG. 1 in more detail.

FIG. 1 shows a high-pressure discharge lamp with a discharge vessel 1, which is provided with an ionizable filling containing metal halide. The lamp has a power of 400 W. The discharge vessel 1 is made from densely sintered polycrystalline aluminum oxide, and provided with two electrode feedthroughs 2 and 3. By means of a sealing glass the feedthrough 2 is connected in a vacuum tight manner to a densely sintered aluminum oxide tube 4 which is sintered into the end wall 5 of the discharge vessel 1. The electrode feedthrough 2 comprises a cermet rod 6 which is secured, at its first end 7, to the first end 8 of an electrode pin 9 by means of a welded joint. The cermet rod is composed of a sintered mixture of aluminum oxide and 35% molybdenum. The material of the electrode pin is tungsten, which may be doped with, for example, K and/or Re, or a tungsten alloy doped with, for example, Re. The cermet rod 6 is connected by its second end 12 to a niobium pin 13, and the electrode pin 9 carries a tungsten electrode spiral 11 at its second end 10.

FIG. 2 is a more detailed view of the electrode feedthrough of the lamp shown in FIG. 1. The cermet rod 26 has a diameter of 2.05 mm and is secured, at its first end 27, to the first end 28 of the tungsten pin 29 by means of a welded joint. The pin 29 has a diameter of 1.18 mm and carries the electrode spiral 31 at its second end 30. Near the interface 34 between the pin and the rod, the pin exhibits a solidified tungsten melt 35, which is caused by applying the welding energy to said location during the manufacture of the electrode feedthrough. The melt 35 has a diameter of 0.6 mm and extends to approximately 0.1 mm from the interface 34. The melt 35 does not contact the interface 34. In addition, damages such as welding edges and fins on the cermet rod do not occur. The distance between the melt 35 and the interface 34 (the distance from the middle point of the melt to the interface) is approximately 0.4 mm. This distance should generally not exceed the diameter of the tungsten pin in order to allow the temperature of the first end of the cermet rod to be sufficiently high, during the manufacture of the electrode feedthrough, to form a welded joint at the interface 34. At its first end 28, the tungsten pin 29 has a second solidified tungsten melt (not shown in the drawing) of substantially the same dimensions as the melt 35, which second solidified tungsten melt is situated diametrically opposite the solidified melt 35 and at the same distance from the interface 34. After all, during manufacturing the welded joint, the welding energy is substantially equally distributed to the relevant places on the electrode pin.

Electrode feedthroughs of the type described above were manufactured as follows. A cermet rod having a diameter of 2.05 mm was pressed against a tungsten electrode pin having a diameter of 1.18 mm by applying a force of 1 to 2 N, which rod and pin remained freely movable in the axial direction. Subsequently, a laser whose power was set to 4 kW was used to generate a laser pulse with a pulse duration of 20 ms, the laser beam being divided into two sub-beams, which sub-beams were focused on diametrically opposite target points on the first end of the tungsten pin near the interface between rod and pin. The diameter of the sub-beams on the target spots was 0.6 mm, and the distance from the middle point of the target points to the interface was 0.4 mm. The energy supplied by the laser pulse was 80 J. In this manner, a strong welded joint was obtained between cermet rod and electrode pin, with a tungsten melt, that solidified upon cooling, being formed at the target points of the laser beams. This method was found to be readily reproducible and only little dependent on small variations in process parameters.

The invention claimed is:

1. A high-pressure discharge lamp provided with a discharge vessel having a wall of a ceramic material, and provided with at least one electrode feedthrough comprising a cermet rod, which is secured, at a first end, to a first end of an electrode pin by means of a welded joint, which electrode pin is substantially composed of tungsten and extends in line with the cermet rod, wherein the electrode pin comprises a solidified tungsten melt at its first end in the vicinity of the interface between electrode pin and cermet rod without contacting the cermet rod.

2. A lamp as claimed in claim 1, wherein the solidified tungsten melt has a dimension that is at most equal to the diameter of the electrode pin, and the distance from said solidified tungsten melt to the interface between electrode pin and cermet rod is smaller than half the diameter of the electrode pin.

3. A lamp as claimed in claim 1, wherein the electrode pin exhibits, at its first end, a tungsten melt in three locations on its circumference, which tungsten melts are arranged at an angle of 120° with respect to each other and are at the same distance from the interface.

4. A lamp as claimed in claim 1, wherein the cermet rod is connected at a second end to a niobium pin.

5. A lamp as claimed in claim 1, wherein the electrode pin carries a tungsten electrode spiral at a second end.

6. A high-pressure discharge lamp provided with a discharge vessel having a wall of a ceramic material, and provided with at least one electrode feedthrough comprising a cermet rod, which is secured, at a first end, to a first end of an electrode pin by means of a welded joint, which electrode pin is substantially composed of tungsten and extends in line with the cermet rod, wherein the electrode pin comprises a solidified tungsten melt at its first end in the vicinity of the interface between electrode pin and cermet rod, wherein the electrode pin exhibits, at its first end, a tungsten melt in three locations on its circumference, which tungsten melts are arranged at an angle of 120° with respect to each other and are at the same distance from the interface.

7. A lamp as claimed in claim 6, wherein the cermet rod is connected at a second end to a niobium pin.

8. A lamp as claimed in claim 6, wherein the electrode pin carries a tungsten electrode spiral at a second end.

9. A lamp as claimed in claim 6, wherein the electrode pin comprises a tungsten electrode spiral formed from the electrode pin at a second end.

10. A lamp as claimed in claim 6, wherein the solidified tungsten melt has a dimension that is at most equal to the diameter of the electrode pin, and the distance from said solidified tungsten melt to the interface between electrode pin and cermet rod is smaller than half the diameter of the electrode pin.

11. A lamp as claimed in claim 6, wherein the electrode pin exhibits, at its first end, a tungsten melt in three locations on its circumference, which tungsten melts are arranged at an angle of 120° with respect to each other and are at the same distance from the interface.

* * * * *